US006352448B1

(12) United States Patent
Holliday et al.

(10) Patent No.: US 6,352,448 B1
(45) **Date of Patent: *Mar. 5, 2002**

(54) CABLE TV END CONNECTOR STARTER GUIDE

(75) Inventors: Randall A. Holliday, 4360 Augusta Dr., Broomfield, CO (US) 80020; Sheng Chia Wong, Taipei (TW)

(73) Assignee: Randall A. Holliday, Broomfield, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/657,711

(22) Filed: Sep. 8, 2000

(51) Int. Cl.[7] ..... H01R 9/05
(52) U.S. Cl. ..... 439/585
(58) Field of Search ..... 439/585, 578, 439/528, 583, 683, 350, 584

(56) References Cited

U.S. PATENT DOCUMENTS 3,601,524 A * 8/1971 Kauffman ..... 174/75 R
5,232,377 A * 8/1993 Leibfried, Jr. ..... 439/320
5,392,508 A 2/1995 Holliday et al. ..... 29/751
5,596,800 A 1/1997 Holliday et al. ..... 29/751
5,651,698 A * 7/1997 Locati et al. ..... 439/578
5,769,662 A * 6/1998 Stabile et al. ..... 439/578
5,938,465 A * 8/1999 Fox, Sr. ..... 439/350
6,159,046 A * 12/2000 Wong ..... 439/578
6,179,656 B1 * 1/2001 Wong ..... 439/578

* cited by examiner

*Primary Examiner*—Tho D. Ta
*Assistant Examiner*—Phoungchi Nguyen
(74) *Attorney, Agent, or Firm*—John E. Reilly

(57) ABSTRACT

A guide for coaxial cable end connectors having a crimping ring at one end of the connector which receives the end of the coaxial cable, a cylindrical insert disposed in a central bore of the connector body and has a recessed portion for loose-fitting insertion of the cable to maintain centered to the body as the cable is advanced with the body. In one form, the guide is free to be removed from the body once the cable is fully inserted, and in another form has a tubular insert through which the cable is inserted and advanced into engagement with an extension pin with the tubular insert in surrounding relation to the extension pin. In one form, a starter plug supports an extension pin in the body and facing the male end of the cable so that the male end will advance the extension pin toward the opposite end of the connector body as the cable is advanced into the body.

25 Claims, 4 Drawing Sheets

CABLE TV END CONNECTOR STARTER GUIDE

BACKGROUND AND FIELD OF INVENTION

This invention relates to installation guides; and more particularly relates to novel and improved installation guide for coaxial cable end connectors used in splicing the cable to another cable or connecting to a post or terminal.

I have previously devised end connectors for effecting sealed engagement with one end of the coaxial cable by applying a crimping force to a sleeve on the connector body which will uniformly reduce the diameter of the sleeve into a generally conical configuration which snugly engages the end of the cable, reference being made to U.S. Pat. Nos. 5,392,508 and 5,596,800. End connectors of the type disclosed in those patents require the use of a separate crimping tool and are primarily intended for use by professional cable installers. However, it was found that there are a number of situations in which it was not feasible to purchase a crimping tool or where a crimping tool was not available either to splice coaxial cables together or to connect one end of the cable via a connector fitting into a post or terminal. In order to fulfill that need, I devised other versions of crimping devices in which crimping rings were pre-installed on the end connector in such a way that the installer could crimp the end connector onto a cable using standard tools, such as, a crescent wrench or pliers. Subsequently, other low cost crimping tools have been developed to facilitate crimping of the end connector in an efficient and reliable manner.

In utilizing crimping devices in the form of pre-installed crimping rings which extend beyond the end or entrance of the electrically conductive member into the end connector has resulted in substantially increased spacing between the end of the crimping ring and the inner sleeve which receives the electrically conductive pin member. As a result, in attempting to insert the pin member and surrounding dielectric into the sleeve, if not properly centered, makes it difficult to properly insert the outer jacket and braided conductor layer of the cable into the annular space between the inner and outer sleeves of the connector body without damaging or distorting the outer layers but in any event can result in an extremely poor fit between the cable and connector as a preliminary to the crimping operation. Maintaining proper alignment and centering of the pin is therefore important in assuring a good fit and effecting sealed engagement between the end connector and cable and is especially critical in connectors used in digital communications.

SUMMARY OF THE INVENTION

Accordingly, it is an object of the present invention to provide for a novel and improved installation guide for securing a cable to another member and in such a way as to maintain precise concentric alignment in a dependable and highly simplified manner.

Another object of the present invention is to provide for a novel and improved installation guide for connecting a coaxial cable to an end connector or for splicing two coaxial cables together which is low cost, requires a minimum number of assembly steps, assures precise alignment and sealed engagement between the parts, and prevents shorting between the electrically conductive foil layer on the cable and the conductor pin on the cable as well as conductor portions of the starter guide.

It is a further object of the present invention to provide for a novel and improved installation guide inserted into an end connector having a pre-installed crimping ring as a preliminary to insertion and crimping of a coaxial cable to the connector and in such a way that the installation guide can either be automatically discarded when the parts have become properly assembled or can remain in place as a part of the assembly.

It is a further object of the present invention to provide for alternate forms of installation guides which either may be temporarily or permanently mounted within an end connector to assure assembly of the coaxial cable in precise alignment with another cable or with a post or terminal to which it is to be attached.

In accordance with the present invention, an installation guide has been devised which is comprised of an elongated insert adapted for insertion into engagement with an inner wall of the end connector and wherein the guide projects forwardly toward the entrance of the connector and is recessed at its forward end to receive the male end or electrically conductive pin portion of the cable to retain the cable in centered relation for insertion into sealed engagement as a preliminary to being joined to the connector, such as, by crimping. In one form, the installation guide is slidable rearwardly with the cable as it is advanced into mating relation to the end connector, and the guide is free to fall away from or be removed from the opposite end of the connector prior to connection of the cable to another cable or to a post or terminal, as the case may be.

In another form of invention, the installation guide is in the form of a tubular insert placed in the inner wall of the end connector and defines a guide passage for advancement of the conductive portion of the cable therethrough and into engagement with another elongated conductor member at the one end of the connector opposite to insertion of the cable. This alternate form is adapted for use more with even greater length connectors than the first form, such as, a BNC connector in which an extension of the conductive portion of the cable is required in order to make the necessary electrical connection with the terminal. Accordingly, the guide insert itself is formed with a pin-receiving bore which is surrounded by seizure prongs which contract against the pin when the pin is inserted in to the bore. The guide tube itself is preinstalled into the inner sleeve to a first position and, when the conductor pin is inserted into the bore, the end of the dielectric surrounding the conductor pin will abut the end of the guide tube and force it rearwardly a limited distance until the pin itself becomes seized by the prongs at the opposite end of the connector to the entrance. Thus, the guide tube serves the dual purpose of an improved electrical connection with minimal return losses and proper alignment of the conductor pin and dielectric within the inner sleeve of the connector.

As a still further modification of the form of invention, the guide insert is in the form of an extension pin with a pin-receiving bore surrounded by seizure prongs to contract against the conductor pin of the cable when the latter is advanced through the crimping ring. However, in place of the tubular insert of the alternate form just described, the extension pin is preassembled into a starter plug which is supported at the front end of the end connector and in turn supports the extension pin in a position to receive the conductor pin on the cable as it is initially advanced through the crimping ring. The starter plug will fall off once the extension pin is advanced through the connector until the starter plug reaches a limit stop. In this way, the assembler can determine that the cable has been advanced the proper distance into the connector for complete assembly.

It is therefore to be understood that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed and reasonable equivalents thereof.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
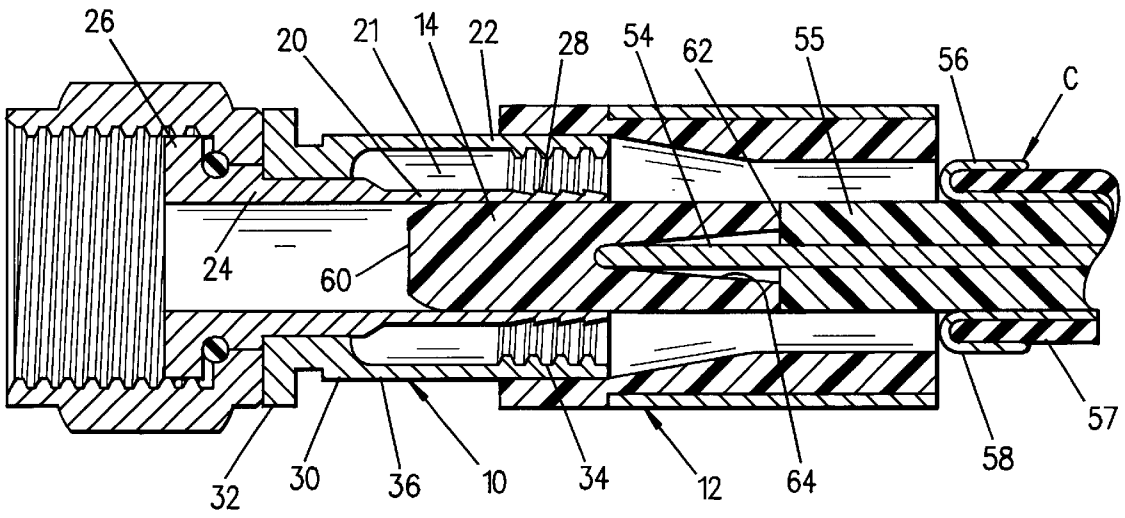
FIG. 1 is a longitudinal section view illustrating one preferred form of installation guide in assembled relation to an end connector in accordance with the present invention, the guide being illustrated at the initial stages of engagement with a coaxial cable being inserted into the end connector.
Figure 2:
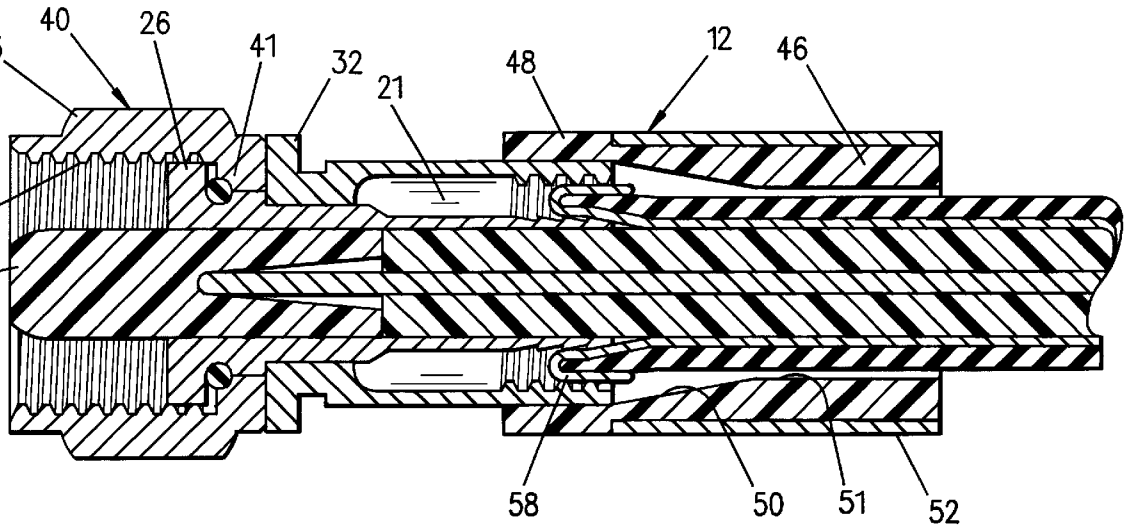
FIG. 2 is another sectional view corresponding to FIG. 1 but illustrating in continued advancement of the coaxial cable into the end connector.
Figure 3:
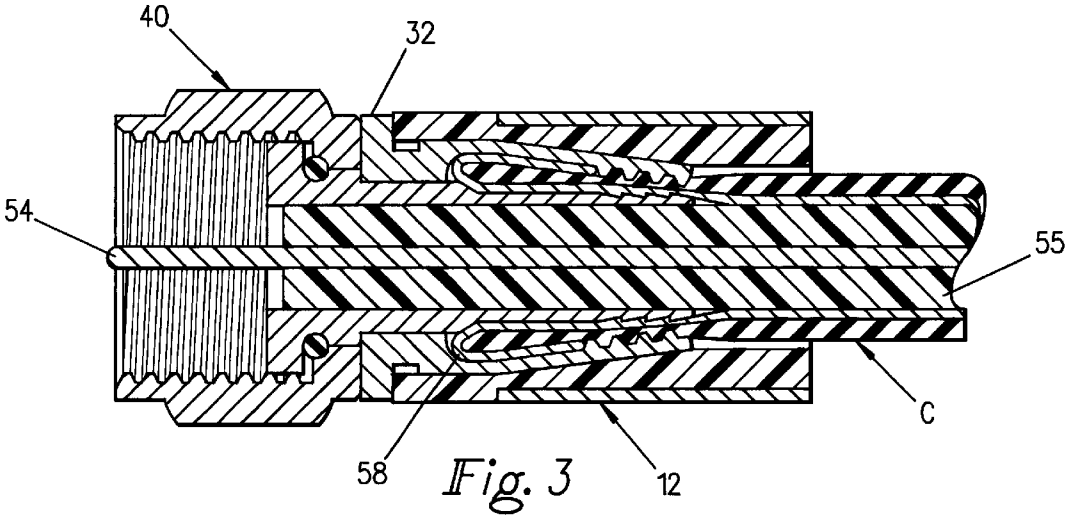
FIG. 3 is another sectional view of the first preferred form and illustrating the continued advancement of the coaxial cable into fully assembled relation to the end connector and preliminary to crimping of the end connector.

Referring in more detail to the drawings, there is shown by way of illustrative example in FIGS. 1 to 3, one standard form of end connector 10 of the type having a crimping ring 12 at one end through which an installation guide 14 is inserted to facilitate assembly and attachment of a standard coaxial cable represented at C to the connector 10. The end connector 10 is broadly comprised of a concentrically spaced inner sleeve 20 and outer sleeve 22, the inner sleeve having any inner wall surface 21 which defines the smallest diameter of the opening or bore through the end connector 10 and verges into a cylindrical body 24 which terminates in an external shoulder 26. The inner sleeve 20 includes a plurality of external serrations 28 angled in a direction away from the entrance end of the connector 10 which receives the cable C.

The outer sleeve 22 similar includes a cylindrical body 30 and an external shoulder 32 at one end opposite to a series of ribs or endless rings 34 in facing relation to the serrations 28 on the inner sleeve 20. External surface 36 of the outer sleeve is substantially smooth and of uniform diameter along its greater length to facilitate mounting and slidable advancement of the crimping ring 12.

A ferrule 40 includes a flange 41 interposed between the shoulders 26 and 32 and is internally threaded as at 42 to facilitate attachment to a conventional post or terminal. A plurality of flats 43 are formed on the external surface of the ferrule to facilitate tightening or loosening of the end connector with respect to the post or terminal by means of a wrench or other suitable tool, not shown.

The crimping ring 12 is of a type that can be preinstalled on the end connector and includes an annular body 46 preferably composed of a low-frictional material having limited compressibility, such as Delrin®, or a similar hardened plastic material. One end portion 48 of the body 46 is cylindrical and relatively thin-walled with an internal diameter substantially equal to, or slightly less than, the external diameter of the outer sleeve 22 so that the crimping ring 12 can be press fit onto the end of the end connector 10. The body 46 thickens gradually away from the end portion 48 so as to define a tapered internal surface 50 leading into a cylindrical inner surface 51. An exterior surface of the body 46 is undercut or recessed from a point just forwardly of the end portion 48 to receive a reinforcing band 52 which is preferably composed of a brass material. The reinforcing band 52 fits snugly over the ring body 46 and has an external diameter substantially equal to that of the end portion 48 so as to be substantially flush with the end portion. Cable C must therefore advance along the interior surface of the crimping ring 12 prior to engagement or insertion of the outer portion of the cable into the annular space between the sleeves 20 and 22. Of course, the cable C is of conventional construction and is broadly made up of an inner conductor pin 54 surrounded by a dielectric insulator 55 of rubber or rubber-like material, an outer braided conductor 56 and an outer jacket 57 also of rubber or rubber-like material. Prior to inserting the end of the cable C through the crimping ring 12 into the end connector 10, the cable end is prepared by removing a first length of the outer jacket 57 and braided conductor 56, and a shorter length of the dielectric insulator 55 is removed to expose an end of the conductor pin 54 as well as a thin layer of foil F surrounding the pin 54. In addition, the braided conductor 56 is peeled away from the insulator 55 and doubled over a forward end of the jacket 57, the doubled over portion designated at 58.

The foregoing is given more by way as a representative example of end connector and cable wherein the practice in the past has been merely to insert the cable through the crimping ring and make a blind insertion of the doubled over portion 58 of the cable C into the annular space 21 formed between the inner and outer sleeves 20 and 22. Unless the doubled over portion 58 of the cable C is precisely aligned with the space 21, however, it is difficult if not impossible to fully insert into the space 21, as illustrated in FIGS. 2 and 3, without misshaping or damaging the outer layers 57 and 58. Therefore, in accordance with the present invention, the installation guide 14 is provided as a means for establishing precise alignment of the cable C as it is inserted into the end connector. In the form of installation guide 14 as shown in FIGS. 1 to 3, the guide 14 takes the form of an elongated cylindrical rod composed of a rubber or plastic material which is electrically non-conductive and substantially rigid. The guide 14 is of a diameter or size substantially equal to or just greater than the inner diameter of the inner sleeve 20 so as to be capable of fitting snugly into the central opening within the inner sleeve 20 but axially slidable therethrough when subjected to a positive pressure. Moreover, the guide 14 is of a length approximating the length of the crimping ring 12 and has a beveled end 60 to facilitate ease of partial insertion of the guide 14 into the central opening and with the opposite end 62 of the guide positioned in proximity to the entrance end of the crimping ring 12. In addition, the end 62 is provided with a tapered bore 64 of generally conical configuration tapering rearwardly from the end and symmetrically about the longitudinal axis of the longitudinal guide 14 for the purpose of receiving the male end or conductive pin 54 of the cable C, as illustrated in FIG. 1. FIG. 1 illustrates insertion of the conductor pin 54 into the bore 64 and initial advancement of the guide rearwardly along the inner wall of the inner sleeve 20. Under continued advancement of the cable and guide, as shown in FIG. 2, the doubled-over portion 58 of the cable is precisely aligned with the annular space 21 between the sleeves 20 and 22 and will undergo separation from the inner dielectric 55 as it is expanded in a radial outward direction into the space. At the same time, the guide 14 will continue to slide rearwardly through the end connector and, once it clears or at least protrudes from the end 43 of the inner wall of the body 24 of the sleeve 20, can be removed or discarded from the end of the cable C. In this regard, the male end or pin 54 of the cable C is centered by the guide until the doubled over portion 58 of the cable C is inserted into the space 21 between the sleeves 20 and 22 but nevertheless the male end 54 is in loose-fitting engagement within the bore 64 so that the guide can be easily removed if not merely drop off of the end 54 once the guide clears the end flange 26 of the sleeve 20. At this point, the conductive pin 54 is supported in centered relation to the ferrule 40 and the ferrule 40 can be threaded into engagement with a post or terminal in accordance with well-known practice.

DETAILED DESCRIPTION OF MODIFIED FORMS OF INVENTION

Figure 4:
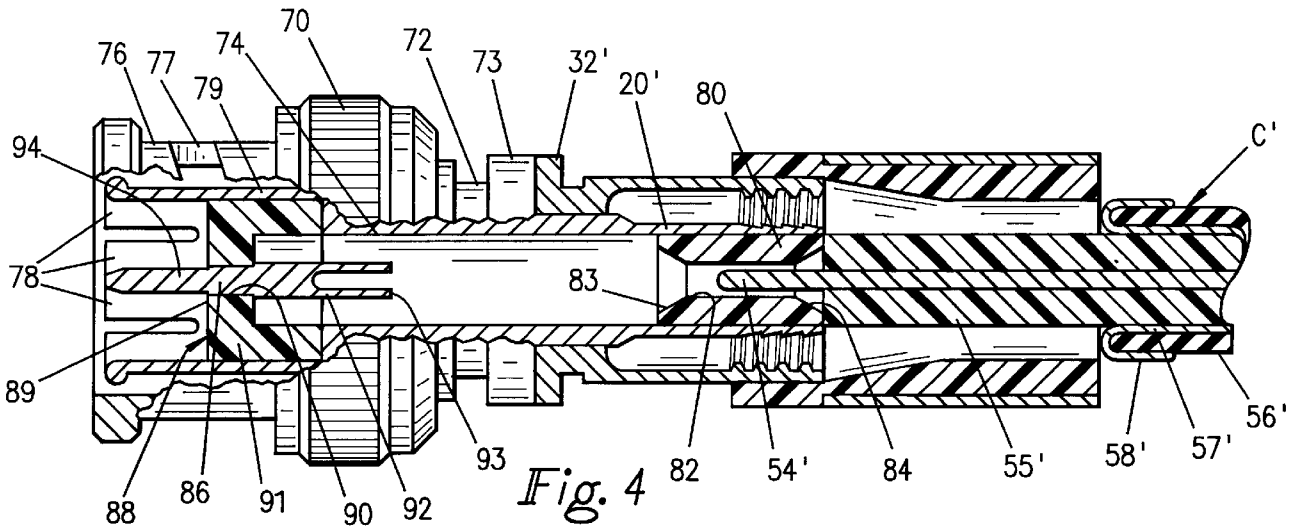
FIG. 4 is a longitudinal sectional view of a modified form of invention utilizing a BNC-type end connector and a coaxial cable at its initial stage of insertion into the connector.
Figure 5:
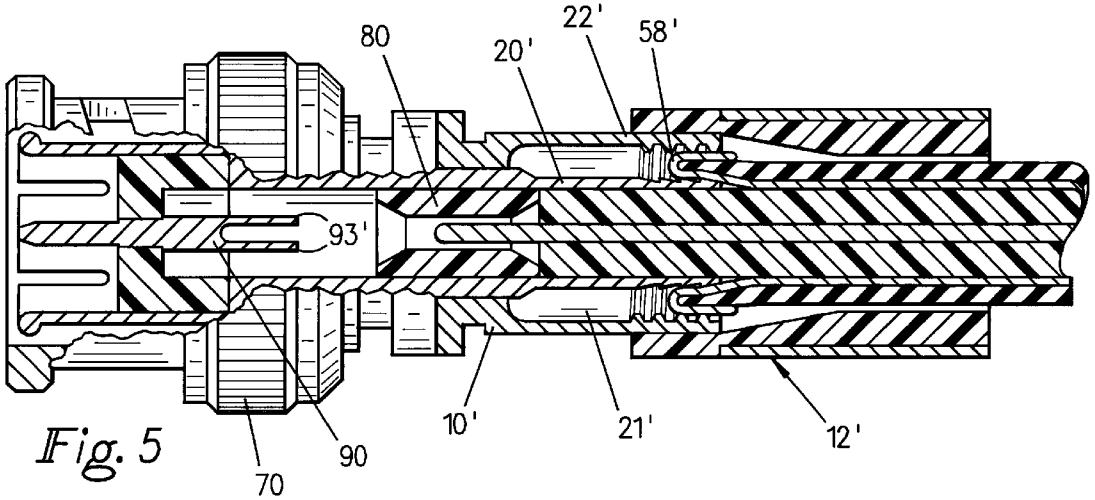
FIG. 5 is a sectional view corresponding to FIG. 4 illustrating continued advancement of the coaxial cable into assembled relation to the BNC.
Figure 6:
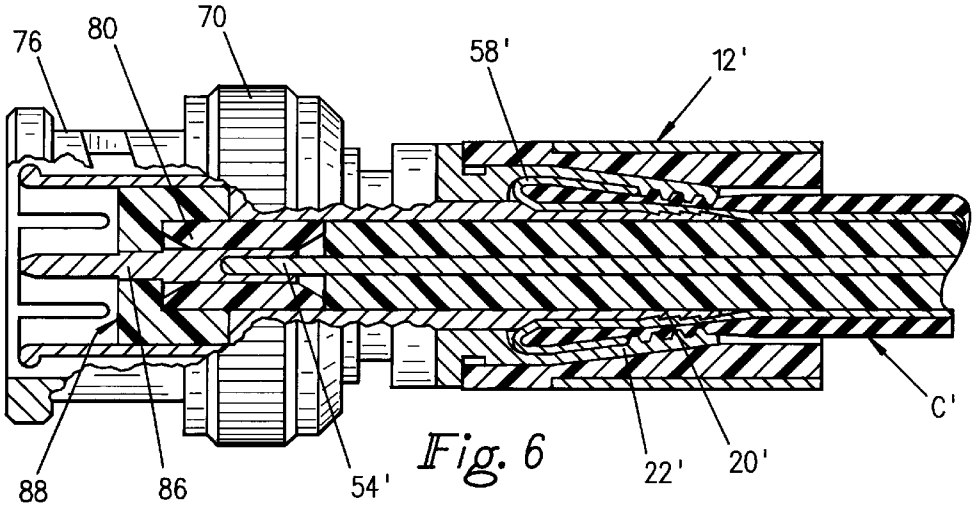
FIG. 6 is another sectional view corresponding to FIGS. 4 and 5 but illustrating the coaxial cable after it is fully inserted into the connector and prior to crimping of the connector.

A modified form of alignment guide assembly is illustrated in FIGS. 4 to 6 for a BNC connector in which like parts to those of FIGS. 1 to 3 are correspondingly enumerated with prime numerals. The BNC connector presents the same essential problem as end connector 10 of FIGS. 1 to 3 in that the crimping ring 12' results in an increased spacing between the end of the end connector 10' and inner and outer sleeves 20' and 22' which receive the outer layers of the cable C'. In addition, the installation guide assembly to be described must serve as an extension of the conductor pin 54' in order to make the necessary connection with the post or terminal. This is owing in part to the additional length of the BNC connector 10' beyond the flange 32'. More specifically, and in accordance with standard practice, a ferrule 70 is mounted on the cylindrical casing 72 which terminates in an external shoulder 73 in abutting relation to the flange 32' and is mounted on an extension 74 of the inner sleeve 20'. A barrel portion 76 forms an axial extension or continuation of the ferrule 70 and is provided with one or more angular bayonet slots 77. Post-engaging prongs 78 on a cylindrical liner 79 are concentrically spaced within the barrel 76 to facilitate attachment in a conventional manner to the post or terminal.

The installation guide assembly of the modified form of invention is broadly comprised of an elongated tubular insert 80 which is composed of a rubber, plastic or other electrically non-conductive material including a central bore or passage 82 which terminates in opposite countersunk ends 83 and 84. The tubular insert 80 is dimensioned to be of a size or diameter which will snugly engage the inner wall of the sleeve 20' but can be slidably advanced along the inner wall of the sleeve 20' under positive pressure. The installation guide assembly additionally includes an extension pin 86 which is centrally supported by an annular support 88 at the ferrule end of the connector 10'. The support 88 extends radially in an outward direction from a central opening 90 into which the extension pin 86 is mounted, and support 88 terminates in an outer, axially extending annular wall portion 91 which is press fit into firm engagement with the inner surface of a cylindrical lining 79. The extension pin 86 includes an enlarged end 92 having an opening or recessed end 93 for insertion of the conductive pin 54' and a reduced end 94 which tapers away from the enlarged end 92 in a direction toward the open end of the barrel 76. The support 88 is composed of an electrically non-conductive material such as rubber or plastic securely fixed within the lining 79.

In the assembly of the cable C' into connected relation to the BNC connector, the outer jacket 56' is cut back and the braided layer 57' is peeled back from the inner dielectric layer 55' and is doubled over the jacket 56' as at 58'. The tubular insert or guide 80 is inserted at least partially into the opening of the inner sleeve 20', and the extension pin 86 is already installed as described within the opposite end of the connector. The cable C' is advanced initially into the position shown in FIG. 4 with the conductive pin 54' housed within the tubular insert 80 and, under continued advancement, the inner dielectric layer 55' slides into abutting relation to the insert 80 causing it to slidably advance rearwardly toward the extension pin 86 as shown in FIG. 5, and the outer layers 56' and 57' of the cable C' enter the annular space 21' between the sleeve 20' and 22'. As shown in FIG. 6, the assembly is completed by continued advancement of the tubular insert 80 through the tubular extension 74 until the insert 80 receives the enlarged end 92 of the extension 86 and the conductive pin 54' is inserted into the end portion 93. The end portion 93 is also longitudinally split so as to form diametrically opposed prongs 93' which are sprung or forced inwardly by the tubular guide 80 into snug-fitting engagement with the pin 54.

Figure 7:
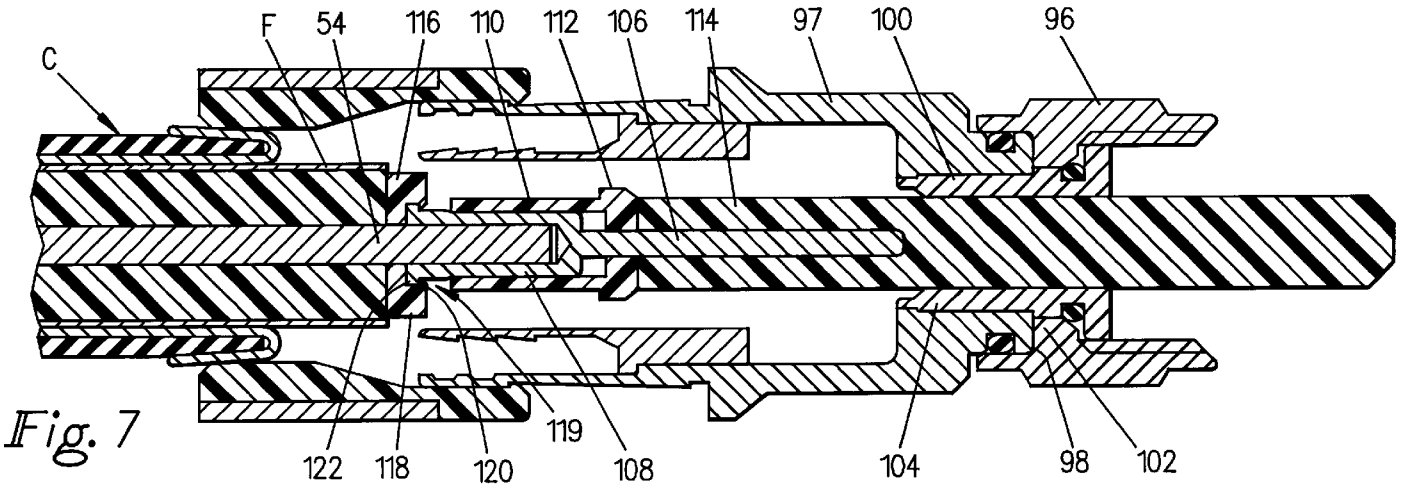
FIG. 7 is a longitudinal section view of another modified form of starter guide showing a coaxial cable at its initial stage of insertion into the connector and a protective cap to prevent shorting between a conductor foil portion of the cable and the starter guide.
Figure 8:
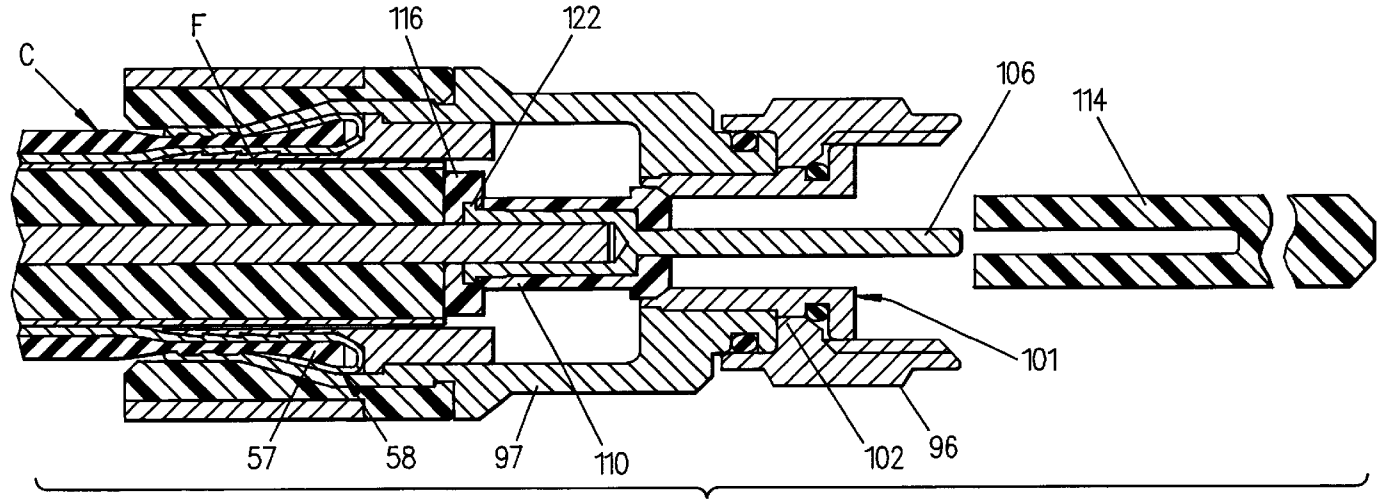
FIG. 8 is a sectional view corresponding to FIG. 7 and illustrating continued advancement of the conductor pin of the coaxial cable into the socket end of the starter guide.

Still another modified form of invention is illustrated in FIGS. 7 and 8 in which like parts to those of FIGS. 1 to 6 are correspondingly enumerated. The end connector is shown as an F connector, but the modified form is equally adapted for use with other CATV connectors, such as, an RCA connector and includes a ferrule 96 having an external shoulder 102 which abuts a flange 98 at the end of the connector body 97. The ferrule 96 is internally threaded at its entrance for threaded insertion of a bushing 100. The bushing 100 includes an enlarged head 101 which bears against the internal shoulder 102, and the opposite leading end of the bushing 100 is beveled as at 104 to serve as a limit stop for advancement of the starter guide assembly now to be described.

The starter guide assembly is made up of an electrically conductive extension pin 106 having a pronged end portion 108 defining a central bore for insertion of the standard conductor pin 54 of the coaxial cable C. In turn, the pronged end 108 which is of increased diameter with respect to the metal extension pin 106, is inserted into an outer socket 110 having an external shoulder 112 tapering forwardly into an elongated cylindrical rod or plug 114. The plug 114 is separable from the shoulder 112 and is dimensioned to be freely slidable through the bushing 100 but nevertheless support the metal pin 54 along the longitudinal axis of the connector.

The metal pronged end 108 is inserted into the outer concentric socket 110 as shown with the metal extension pin 106 extending for a distance such that when the outer jacket 57 and outer braided layer 58 are fully inserted into the annular space 21 between the inner and outer sleeves 20 and 22 the metal extension pin will extend through and beyond the bushing 100 to terminate substantially flush with the entrance end of the ferrule 96. The extent of axial movement of the metal extension pin 106 is further controlled by the beveled end 104 of the bushing 100 limiting axial movement of the external shoulder 112 when the outer layers 57 and 58 of the cable C are inserted into the annular space 21 as described. In order to prevent accidental shorting between the foil layer F and extension pin 106, a protective cap 116 is press-fit over the entrance to the pronged end portion 108. Preferably, the cap is formed of a plastic material of limited flexibility having an external shoulder 118 surrounding a central opening 119, and an annular flange 120 at the leading end of the shoulder 118 is dimensioned for engagement behind the enlarged end 122 of the pronged end portion 108. In this way, the shoulder 118 as well as side wall of the cap 116 will effectively act as a barrier against accidental engagement between any ragged end portions of the foil F and the conductor portions of the pronged end 108 as well as the extension pin 106. The length of the plug 114 is not as critical as the metal extension pin 106 but nevertheless should be of sufficient length to support the end 110 in a position close enough to the end of the crimping ring 12 that the installer can readily align the conductor pin 54 with the pronged end 106. Although acting as a support, the starter plug 114 is dimensioned to loosely fit over the metal extension pin 106 as well as to be readily slidable through the bushing so that when the extension pin 106 is advanced to the fully assembled or final position as shown in FIG. 8, the plug 114 will be free to slide off or be removed manually by the installer.

It will be appreciated that the starter or installation guide as herein described with respect to FIGS. 1 to 8 is readily conformable for use in a wide diversity of couplings or connections in order to facilitate advancement of a pliable elongated element, such as, a coaxial cable to assure a proper fit within a connector body to which it is to be connected and in particular where it is important to assure sealed engagement between the members. The diameter and length of the guide can be proportioned in accordance with the size and relative length of the connecting elements, and the particular types of connectors and cables described are intended to be more for the purpose of illustration but not limitation. For example, the plug 114 and extension pin 106 are equally suitable for use in the F connector of FIGS. 1 to 3 and the BNC-type connector illustrated in FIGS. 4 to 6.

It is therefore to be understood that while preferred and alternate forms of invention are herein set forth and described, the above and other modifications and changes may be made without departing from the spirit and scope of the present invention as described by the appended claims.

We claim:

1. In an end connector fitting for connecting a male end of a coaxial cable in centered relation to a hollow cylindrical connector body, said connector body including a sleeve member extending from one end thereof, the improvement comprising:

a starter guide of elongated cylindrical configuration slidably disposed in said connector body having a recessed portion at one end thereof in facing relation to said male end of said cable, said guide projecting axially through at least a portion of said sleeve, and said recessed portion being sized for loose-fitting insertion of said male end of said cable wherein said guide member is slidable away from said sleeve member and through said connector body in response to axial movement of said male end of said cable through said connector body.

2. In an end connector fitting according to claim 1 wherein said starter guide is of a length such that it will extend axially for the greater length of said sleeve when mounted in said connector body.

3. In an end connector fitting according to claim 1 wherein said starter guide is of tubular configuration and said male end of said cable is insertable through said starter guide.

4. In an end connector fitting according to claim 3 wherein an extension pin is mounted in axially spaced relation to said starter guide and said male end is slidable into engagement with an end of said extension pin.

5. In an end connector fitting according to claim 1 wherein said male end of said cable is defined by an elongated pin.

6. In an end connector fitting according to claim 2 wherein said recessed portion is in the form of a generally conical bore.

7. In an end connector fitting according to claim 6 wherein said starter guide is composed of an electrically non-conductive plastic material.

8. In an end connector fitting for connecting a male end of a coaxial cable in centered relation to a hollow cylindrical connector body having radially inner and outer spaced concentric sleeve members defining an annular space therebetween for insertion of one or more outer layers of said male end in said space, said sleeve members extending from one end of said body with a crimping ring disposed at one end of said sleeve members, the improvement comprising:

a starter guide of elongated configuration having a bore at one end in facing relation to said male end, said starter guide being dimensioned for slidable insertion into said inner of said sleeve members and to project axially therethrough, said bore being centered in relation to said inner of said sleeve members and dimensioned for loose-fitting insertion of said male end of said cable whereupon axial slidable advancement of said cable through said crimping ring and insertion of said outer layer(s) into said space said starter guide will follow slidable advancement of said male end through said connector body.

9. In an end connector fitting according to claim 8 wherein said bore is of generally conical configuration tapering away from said one end of said guide.

10. In an end connector fitting according to claim 8 wherein said guide is of a plastic material and in the form of a pin sized to frictionally engage an inner wall of said inner sleeve.

11. In an end connector fitting according to claim 8 wherein said starter guide is of tubular configuration and said male end of said cable is insertable through said starter guide.

12. In an end connector fitting according to claim 8 wherein an extension pin is mounted in axially spaced relation to said starter guide and said male end is slidable into engagement with an end of said extension pin.

13. In an end connector fitting according to claim 12 wherein said extension pin includes seizure prongs engageable with said male end.

14. In an end connector fitting for connecting a male end of a coaxial cable in centered relation to a connector body wherein said body includes a sleeve member extending from one end thereof, and a crimping ring extending from said sleeve, the improvement comprising:

a starter guide comprising an elongated tubular insert mounted in centered relation to said connector body for insertion of said male end therethrough and wherein said tubular insert is slidable through said connector body in response to axial movement of said cable into said connector body.

15. In an end connector fitting according to claim 14 wherein an extension pin is mounted in said connector body in axially spaced relation to said tubular insert at one end of said connector body opposite to insertion of said male end, said extension pin provided with a recessed portion at one end in facing relation to said tubular insert for insertion of said male end therein.

16. In an end connector fitting according to claim 15 wherein said tubular insert is slidable into surrounding relation to one end of said extension pin in response to axial advancement of said cable into said connector body.

17. In an end connector fitting according to claim 15 wherein support means of nonconductive material is disposed at said one end of said connector body for mounting said extension pin in centered relation to said connector body.

18. In an end connector fitting according to claim 17 wherein said extension pin is provided with prongs in surrounding relation to said recessed portion to frictionally engage said male end.

19. In an end connector fitting for mounting a male end of a coaxial cable in centered relation to an annular connector body having radially inner and outer spaced concentric sleeve members which define an annular space therebetween for insertion of one or more outer layers of said male end in said space, and a crimping ring projecting from one end of said sleeve members, the improvement comprising:

a starter guide of elongated cylindrical configuration slidably disposed in said connector body and having an electrically conductive extension pin at one end thereof in facing relation to said male end of said cable to be mounted therein, said extension pin being sized at one end for insertion of said male end of said cable, and limit stop means on said starter guide for limiting axial advancement of said extension pin to a predetermined position with respect to an opposite end of said connector body in response to axial advancement of said male end.

20. In a fitting according to claim 19 wherein said extension pin is inserted in loose-fitting relation to said starter guide, said starter guide being removable from said extension pin when said extension pin has reached its end limit of advancement through said connector body.

21. In a fitting according to claim 19 wherein said one end of said extension pin includes a pronged end portion and external shoulder means on said pronged end portion composed of insulating material to prevent shorting between a foil layer on said cable and said extension pin.

22. In a fitting according to claim 21 wherein said external shoulder means is in the form of a protective cap in pressfit relation to said pronged end portion, said cap having a central opening for insertion of said male end therethrough.

23. In a fitting according to claim 19 wherein said limit stop means is defined by an external shoulder between said starter guide and one end of said extension pin.

24. In a fitting according to claim 23 wherein said one end of said extension pin includes a pronged end portion for insertion of said male end therein.

25. In a fitting according to claim 24 wherein said starter guide includes a socket portion at one end for insertion of said pronged end portion of said extension pin.

* * * * *